US005657826A

United States Patent [19]

Kuckes

[11] Patent Number: 5,657,826

[45] Date of Patent: Aug. 19, 1997

[54] GUIDANCE SYSTEM FOR DRILLING BOREHOLES

[75] Inventor: Arthur F. Kuckes, Ithaca, N.Y.

[73] Assignee: Vector Magnetics, Inc., Ithaca, N.Y.

[21] Appl. No.: 560,392

[22] Filed: Nov. 17, 1995

Related U.S. Application Data

[63] Continuation-in-part of Ser. No. 341,880, Nov. 15, 1994, Pat. No. 5,575,931.

[51] Int. Cl.[6] ..... E21B 7/04

[52] U.S. Cl. ..... 175/45; 175/62

[58] Field of Search ..... 175/40, 45, 61.62, 175/50, 74

[56] References Cited

U.S. PATENT DOCUMENTS

| | | | |
|---|---|---|---|
| 736,432 | 9/1903 | Owens . | |
| 3,529,682 | 9/1970 | Coyne et al. | 175/45 |
| 3,589,454 | 6/1971 | Coyne . | |
| 3,712,391 | 1/1973 | Coyne | 175/45 X |
| 3,853,185 | 12/1974 | Dahl et al. . | |
| 3,907,045 | 9/1975 | Dahl et al. | 175/45 |
| 4,316,253 | 2/1982 | Psseme . | |
| 4,578,675 | 3/1986 | MacLeod | 175/50 |
| 4,593,770 | 6/1986 | Hoehn, Jr. | 175/40 |
| 4,646,277 | 2/1987 | Bridges et al. . | |
| 4,700,142 | 10/1987 | Kuckes | 175/45 X |
| 4,791,373 | 12/1988 | Kuckes | 175/45 X |
| 4,806,869 | 2/1989 | Chau et al. . | |
| 4,875,014 | 10/1989 | Roberts et al. . | |
| 4,881,083 | 11/1989 | Chau et al. . | |
| 4,933,640 | 6/1990 | Kuckes | 175/45 X |
| 5,074,365 | 12/1991 | Kuckes . | |
| 5,218,301 | 6/1993 | Kuckes . | |
| 5,230,387 | 7/1993 | Waters et al. . | |
| 5,305,212 | 4/1994 | Kuckes . | |
| 5,320,180 | 6/1994 | Ruley et al. | 175/45 X |

OTHER PUBLICATIONS

Applied Geophysics, Telford, et al, pp. 144–147.

*Primary Examiner*—Frank Tsay
*Attorney, Agent, or Firm*—Jones, Tullar & Cooper, P.C.

[57] ABSTRACT

A single guide wire system for use in continually directional drilling of boreholes, includes a guidewire extending generally parallel to the desired path of the borehole. The guidewire is connected at a first end to one side of a reversible source of direct current, and at a second end to ground. A second side of the DC source is also connected to ground. A known current flow in a first direction for a first period of time and in a second direction for a second period of time produces corresponding static magnetic fields in the region of the borehole. The vector components of the fields are measured in the borehole by a 3-axis magnetometer, and from these vector components the effects of the Earth's magnetic field are canceled and the distance and direction from the borehole to the guidewire are determined. These values permit control of further drilling of the borehole along a desired path.

9 Claims, 2 Drawing Sheets

MWD CONTROLLER
DRILL
REVERSING SWITCH

GUIDANCE SYSTEM FOR DRILLING BOREHOLES

This is a continuation-in-part of U.S. Ser. No. 08/341,880, filed Nov. 15, 1994, entitled "Single-Wire Guidance System for Drilling Boreholes," now U.S. Pat. No. 5,515,931.

BACKGROUND OF THE INVENTION

The present invention relates, in general, to a method and apparatus for drilling generally horizontal boreholes, and more particularly to a guidance system for drilling such boreholes to a close tolerance to specified end points.

The technology for drilling boreholes into or through hills or mountains, under rivers and the like has been well developed over the years. However, unique problems arise when it becomes necessary to drill such a borehole in an area that is inaccessible, such as beneath a ship's channel in a river, or where multiple boreholes must be drilled in parallel to each other with a high degree of accuracy. In such situations, ordinary techniques for guiding the drilling of boreholes are not always satisfactory.

An example of the need for a high degree of accuracy in drilling boreholes is found in a recently developed procedure for boring horizontal tunnels in unstable Earth. This procedure requires drilling a number of parallel boreholes of small diameter with a high degree of accuracy around the circumference of the tunnel. The boreholes may be, for example, six inches in diameter, with about 40 boreholes positioned around the circumference of the tunnel to form a circle about 20 meters in diameter. The holes are drilled into the hill or mountain in which the tunnel is to be excavated, and are cased with plastic pipe. A refrigerant is then pumped through the casings for an extended period; for example, one month, to freeze the soil. Thereafter, the Earth inside the circle formed by the boreholes is excavated using conventional techniques to produce a tunnel in which the tunnel wall is supported by the frozen Earth. The tunnel may extend partially into the hill or completely through it.

A major problem with the foregoing technique is how to drill a large number of parallel boreholes around the circumference of a tunnel while keeping the boreholes accurately spaced and parallel to each other so as to properly define the tunnel.

Another example of the need for accurate drilling of generally horizontal boreholes is that of drilling boreholes under an obstacle such as a river, where the surface of the Earth above the borehole is not accessible for conventional surface guidance techniques. Such a situation can occur when a borehole is to be drilled under a river to exit at a specified location, but where the river includes an inaccessible region such as a ship's channel. Such a borehole may be started on the near side of the obstacle, with the object of drilling under it to a specific exit point on the far side. Conventional directional drilling techniques can be used to guide the drill at its entry and can provide general control for a portion of the distance. However, such control techniques have limited accuracy, so that a number of boreholes may have to be drilled before the desired exit point is reached.

The prior art describes the use of grids on the surface of the Earth to guide borehole drilling, but if access to the surface above the borehole is not available, this technique cannot be used effectively. Thus, for example, such grids may be placed on the Earth's surface at the banks of a river to provide drilling guidance. However, these grids have a limited range and may not be effective if the borehole is off target when it reaches the grid, for there may not be enough distance to allow the borehole to be turned to reach the exit point.

Thus, there is a need to provide a simple, easy-to-use, effective and accurate method and system for guidance of boreholes, and more particularly to guidance of the drilling of boreholes parallel to a predetermined linear path within small tolerances.

SUMMARY OF THE INVENTION

The present invention is directed a method and apparatus for drilling a horizontal, or generally horizontal, borehole in parallel, closely spaced relationship to a predetermined path. More particularly, the invention is directed to a guidance system for drilling one or more boreholes that will be parallel to a guide path, and when multiple boreholes are drilled, parallel to each other, within a tolerance of plus or minus one-half meter over an indefinite length; for example, over a length of one or two hundred meters up to a kilometer or more.

In accordance with the present invention, a borehole is drilled from an entry point to a desired location, such as a remote exit point, with a high degree of accuracy, through the use of a single guide cable. This guide cable is electrically grounded at one end and is connected at the opposite end to one side of a reversible source of direct current. The other side of the source is also connected to electrical ground. The cable extends adjacent the path to be traveled by the borehole to be drilled. The magnetic field produced by the reversible direct current in this guide cable is detected by a magnetic field sensor carried by the drilling tool being used to drill the borehole. The measurements of this field are used to determine the distance and direction to the guide wire from the borehole sensor, and this information is used to guide further drilling.

This guidance system and method may be used, for example, to guide the drilling of a borehole which must pass by an obstacle to which access is restricted or is otherwise unavailable. In one embodiment, a borehole is to be drilled from a near side of an obstacle such as a river, under the river to a specified exit point on the far side of the river, where access to the river bed is restricted by the presence of a ship's channel, for example. The guide cable of the invention is positioned on the far side of the river so that it passes across the intended exit point and extends into the river bed as far as possible; for example, up to the edge of the restricted area. The guide cable is electrically grounded at the edge of the restricted area, but is electrically insulated from that area to the region of the exit point, where it is connected to, for example, one terminal of a reversible direct current source. The other terminal of the DC source is electrically connected through a suitable cable to a second ground point remote from the exit region. Direct current flow in the cable produces a static magnetic field around the cable between the source and the ground point at the edge of the restricted area.

The borehole being drilled under the river is initially guided by conventional survey techniques until the borehole passes into the static field produced by the guide cable. Thereafter, the borehole is guided by the guide cable magnetic field to follow a path parallel to the guide cable and is directed to the desired end point, such as the exit region, as will be described.

In accordance with a further application of the invention, the grounded guidewire described above may be used in the accurate placement of parallel tunnels extending under or through other obstacles, such as through or into a hillside. The location and direction of each parallel tunnel is defined by a first borehole which may be guided in the manner described above, or may be guided in conventional manner to extend into, or to pass through, a hill or mountain, or to pass under a river, lake or other obstacle, so as to provide guidance for the location of a subsequent tunnel to be excavated. It may be possible to use conventional borehole survey methods to guide this first borehole, as by placing a magnetic field source at the side of the hill opposite to the drill and thereafter drilling directly toward that field source through the Earth. Such a technique can produce a guide borehole for a tunnel with an accuracy of within 1 or 2 meters.

After drilling the guide borehole, the borehole is cased, and a guidewire or cable is fed longitudinally through the entire length of the guide borehole. The guidewire is connected at one end to electrical ground, and, in the preferred embodiment of the invention, is connected at the opposite end to a source of reversible direct current (DC), with the cable being electrically insulated between the ground connection and the current source. The current source is also electrically grounded so as to provide an electrical return path for current flow in the guidewire. Both the guidewire ground and the current source ground are spaced as far as possible away from the tunnel to be excavated. Preferably, in order to minimize the effect of return ground currents, both electrical grounds are spaced at least 50 meters from the nearest end of the tunnel, which may be the entry point where the excavation begins, may be the exit point where the tunnel exits the hill, or when the tunnel does not extend completely through the hill, for example, may be the blind end of the tunnel. In some cases, return currents can be minimized by providing an electrically insulated return cable between the two ground connections.

The reversible DC source supplies current to the guide cable first in one direction for a first period of time and thereafter in a second direction for a second period of time so as to provide around the cable first and second static magnetic fields in opposition directions for use in guiding the drilling of subsequent parallel boreholes, such as multiple boreholes around the circumference of the tunnel. These later boreholes are drilled using measurement while drilling (MWD) guidance techniques, the MWD guidance equipment measuring the direction and magnitude of the apparent Earth's magnetic field, which includes the DC field produced by the guide cable. These measurements are used to determine the distance and direction from the drill to the guide cable, and this information is then used to control the direction of drilling to permit the circumferential boreholes to be accurately drilled in parallel with the guide cable and spaced therefrom by a substantially constant distance, and within small tolerances.

Because of the electrical grounding of the guide cable and of the DC source, return ground currents can be produced which may adversely affect the static magnetic field measurements if the ground points are too close to the ends of the borehole containing the guide cable, and in such a case, compensation is required to maintain accuracy. Alternatively, in some situations it may be possible to minimize the effect of return ground currents by connecting an electrically insulated ground return cable between the two ground connections. Furthermore, corrections may be made to compensate for other anomalies such as railroad tracks or other ferromagnetic material in the region near where the tunnel is to be excavated.

A DC current on the order of 10 amps. may be used in the guide cable for guiding the drilling of boreholes within about a 10 meter radius of the guidewire. The guide cable preferably is a 5/16" diameter monocable of the type used for cased well logging, and thus is insulated and armored to withstand the rigors of a construction site. The magnetic field H produced by current flowing in the guide cable is determined in accordance with the following formula:

$$H=\frac{I}{2\pi r} \qquad \text{(Eq. 1)}$$

Two measurements are made using a three-axis magnetometer at the drilling tool, one with the current at a positive polarity and one with the current at a negative polarity, to obtain the vector components of the apparent Earth's magnetic field, and values obtained thereby are used to calculate the distance and direction to the guide cable. If the ground connections at opposite ends of the guide cable are not sufficiently far from the location of the sensor, the apparent Earth's magnetic field will be affected by ground currents. In this case the measured field H is corrected using the following equation:

$$H=\frac{I\hat{\theta}}{2\pi r}+I\left(\frac{1}{4\pi D_1}+\frac{1}{4\pi D_2}\right)\hat{X} \qquad \text{(Eq. 2)}$$

where I is the current flow through the guide cable, $D_1$ is the distance from the sensor to the current source ground point, $D_2$ is the distance from the sensor to the guide cable ground point, $\hat{\theta}$ is the directional unit vector of the field produced by the current I in the guide cable, and $\hat{X}$ is the effective directional unit vector of the field produced by the ground current.

BRIEF DESCRIPTION OF THE DRAWINGS

The foregoing, and additional objects, features and advantages of the present invention will become apparent to those of skill in the art from a consideration of the following detailed description of a preferred embodiment thereof, taken in conjunction with the accompanying drawings, in which.

DESCRIPTION OF PREFERRED EMBODIMENT

Figures 1, 2:
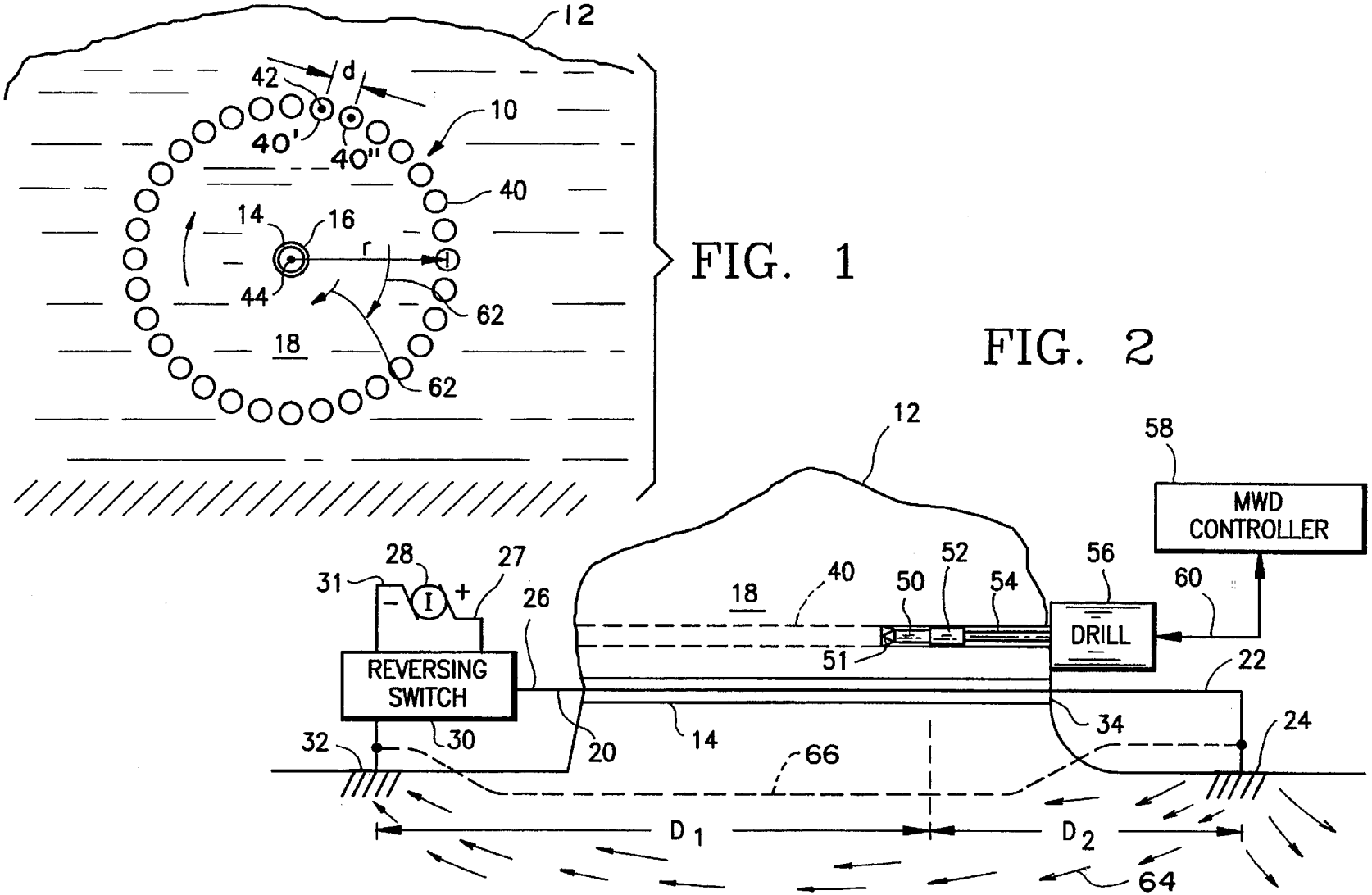
FIG. 1 is an end view of a tunnel site, illustrating a central guide borehole and a multiplicity of surrounding boreholes defining the circumference of the tunnel.
FIG. 2 is a diagrammatic illustration of a side elevation view of a tunnel site with a central guide borehole and a circumferential borehole being drilled using a grounded guide cable in accordance with the invention.

Referring now to FIG. 1, there is illustrated at 10 a tunnel site in a hillside or mountain 12, the tunnel to be excavated into or through the mountain at the location 10 after the placement of boreholes using the method and apparatus herein described. As illustrated, a central or guide borehole 14 is drilled into, or in the illustrated embodiment through, the mountain. The borehole 14, which may be approximately 6" in diameter and cased with a plastic pipe 16, is drilled through the Earth 18 using suitable drilling and borehole guidance and logging techniques. The guide borehole may be drilled in a straight line through the mountain 12, or may be curved, as required. It will be understood that the borehole 14 is illustrated as being drilled through a mountain 12 for purposes of illustration, but could equally well be drilled under a lake or stream, or in any other desired location.

After completion of the guide borehole 14, a conductive wire or cable 20 (FIG. 2) is passed through borehole 14 and is connected at one end, such as the right-hand end 22, to an electrical ground point 24. The opposite end 26 of the cable is connected to one terminal 27 of a direct current source 28 through a reversing switch 30, for example, with the other terminal 31 of the source also being connected through switch 30 to a second electrical ground point 32. The current source 28 preferably is a direct current source, with the reversing switch permitting either the positive or the negative, 27 and 31, respectively, of the source to be connected to cable 20, with the other side being simultaneously connected to the ground point 32.

Cable 20 preferably is electrically insulated and armored to withstand the rigors of a construction site and is of sufficient diameter; for example, 5/16", to carry 10 amps. or more. Preferably, cable 20 is a monocable of the type used for cased well logging.

The ground points 24 and 32 preferably are as far as practical from the corresponding ends of the guide borehole 14, and preferably are at least 50 meters distant. Thus, ground point 24 preferably is at least 50 meters from the end 34 of tunnel 14 and ground point 32 is at least 50 meters from the end 36 of borehole 14, with greater distances being preferred to reduce return ground current flow between points 24 and 32.

After the guide borehole 14 has been completed and the cable 20 placed in it, one or more parallel boreholes, such as a plurality of boreholes 40 in the embodiment of FIG. 1, are drilled around the circumference of the tunnel site 10, as illustrated in FIG. 1. The boreholes 40 may be, for example, 6" in diameter, and are drilled with their center axes spaced 1½ meters apart. Thus, as illustrated in FIG. 1, the boreholes 40' and 40" have their axes 42 spaced apart by a distance d of about 1½ meters for a tunnel which will have a radius r of about 10 meters from the axis 44 of borehole 14 to the axis 42 of boreholes 40. Different borehole diameters and spacings may be utilized for different tunnel sizes, as will be apparent to those of skill in the art.

The boreholes 40 are drilled, as illustrated in FIG. 2, by a drill tool 50 including a drill 51 and a "measurement while drilling" (MWD) package 52 on a drill string 54. The drill string is connected to a conventional drilling assembly 56, with the speed and direction of the drill 51 being regulated by an MWD controller 58 connected to package 52 in known manner. The drill tool 50 is conventional, and is directed through the Earth 18 by the drilling assembly 56 and the controller 58 to produce borehole 40 in the desired location. The exact location of borehole 40 is regulated in accordance with magnetic fields detected in the MWD package 52, as will be explained below.

The MWD package includes a magnetic field sensor, preferably a 3-axis magnetometer, for measuring three vector components of the total static magnetic field along orthogonal x, y and z axes. Output signals corresponding to the vector components are produced by the 3-axis magnetometer, may be amplified in the instrument package, and are then transmitted to the drilling assembly 56 located at the wellhead of the borehole at the Earth's surface. These signals may be transmitted to assembly 56 by cable, by mud pulses, or by other known techniques, in conventional manner, with the signals thereafter being transferred to the MWD controller 58 by way of cable 60. The instrument package 52 may also receive signals from the controller 58 for directional control of the drill 51, again in known manner.

In accordance with the invention, a known direct current is supplied by DC source 28 through switch 30 to the guide cable 20. The current flows through the cable to produce a circular magnetic field 62 (FIG. 1) centered on the cable. This field is a static field with a value H, described by equation 1, and is superimposed on the Earth's magnetic field. These static fields, as well as fields produced by return currents and by magnetic anomalies in the region of the sensor, combine to produce a total, or resultant, static magnetic field in the region of the sensor, which may be referred to as the apparent Earth's magnetic field and which is measured by the magnetometer in instrument package 52. The magnetometer signals are supplied to the controller 58 which determines from the measured values the vector components of field H, and from this determines the distance r between the cable 20 and the instrument package and the direction from the package to the cable. These distance and direction measurements are then used to control the direction of drilling by drill 51 to maintain the borehole 40 on a path which is spaced a constant distance r from guide cable 20 and which follows a path which is parallel to the cable and thus to the axis of guide borehole 14. After each borehole 40 is drilled, it is cased and the drilling equipment is moved to the next borehole to repeat the process so that a multiplicity of boreholes 40 are drilled in side by side relationship, each being parallel to the guide borehole 14 and at a constant distance r from the axis of borehole 14.

As noted above, the magnetic field H is subject to interference from the Earth's magnetic field, from various anomalies in the area where the boreholes are being drilled, and, more importantly, from magnetic fields caused by return currents from the ground point 24 to the ground point 32. The perturbations in the field H due to the Earth's magnetic field can be compensated for by measuring the Earth's field with the magnetometer at the head of the borehole 40 before the drilling is started and, during drilling, by periodically reversing the current source 28 and measuring the field H with the current flowing in a first direction for a period of time; for example, 30 seconds to a minute, and then reversing the current and again measuring the magnetic field. Any difference between the measurements obtained provide correction for the Earth's magnetic field.

Compensation for the magnetic fields caused by ground currents, indicated by arrows 64 in FIG. 2, between ground point 24 and ground point 32 can be provided in accordance with the formula given in equation 2, where the distance $D_1$ is the distance from ground point 32 to the location of the instrument package 52 and where $D_2$ is the distance from ground point 24 to the instrument package 52, as illustrated in FIG. 2. The greater the distances $D_1$ and $D_2$, the smaller will be the effects of these ground currents at the magnetic field sensor in package 52. If the ground points are at least about 50 meters from the borehole ends 34 and 36, the effects of these currents on the value of H will be negligible.

In some applications of the present invention, it may be possible to substantially eliminate the effects of return ground currents by interconnecting the ground points 24 and 32 by a ground return cable 66, as illustrated in dotted lines in FIG. 2. Cable 62 may be on the surface or underground, as desired. For example, in the embodiment of FIGS. 1 and 2, the cable may be placed on the surface to extend around or over the obstacle 12 at a sufficient distance to insure that the field produced by current in this ground return cable does not affect the field produced by the current in guide cable 20.

As noted above, after each of the boreholes 40 is drilled and cased, a refrigerant may be passed through the casings to freeze the Earth 18 surrounding each of the boreholes. Thereafter, the interior of the circle defined by the boreholes 40 can be excavated to provide a tunnel through the mountain 12, with the tunnel being cased in normal manner as it is being excavated.

Although it is convenient to locate the guide borehole 14 in the center of the cylinder defined by the boreholes 40, it will be apparent that, if desired, it can be located to one side or the other of the tunnel location, with each of the boreholes 40 again being drilled in a direction parallel to the guide hole, but with each borehole being at a different distance r from the guide hole, with the distance being constant for the length of the individual borehole. Such a technique may be desirable, for example, when drilling a tunnel underneath a stream or river, in which case the guide cable 20 may simply be placed on the bottom of the river for guidance purposes to enable one or more boreholes to be drilled below the bed of the river at selected distances.

Figure 3:
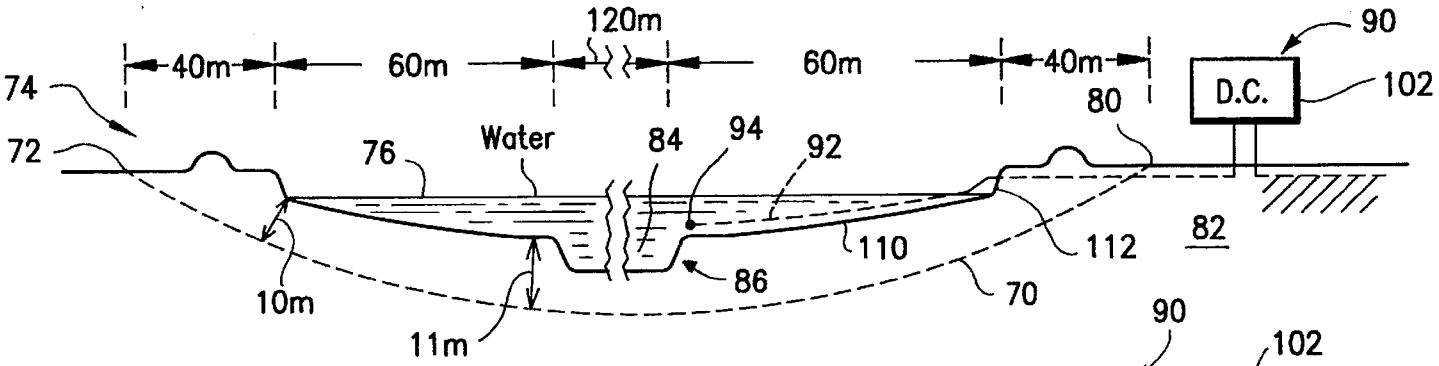
FIG. 3 is a diagrammatic illustration, in side elevation, of a borehole being drilled under an obstacle, using the grounded guide cable of the invention.
Figure 4:
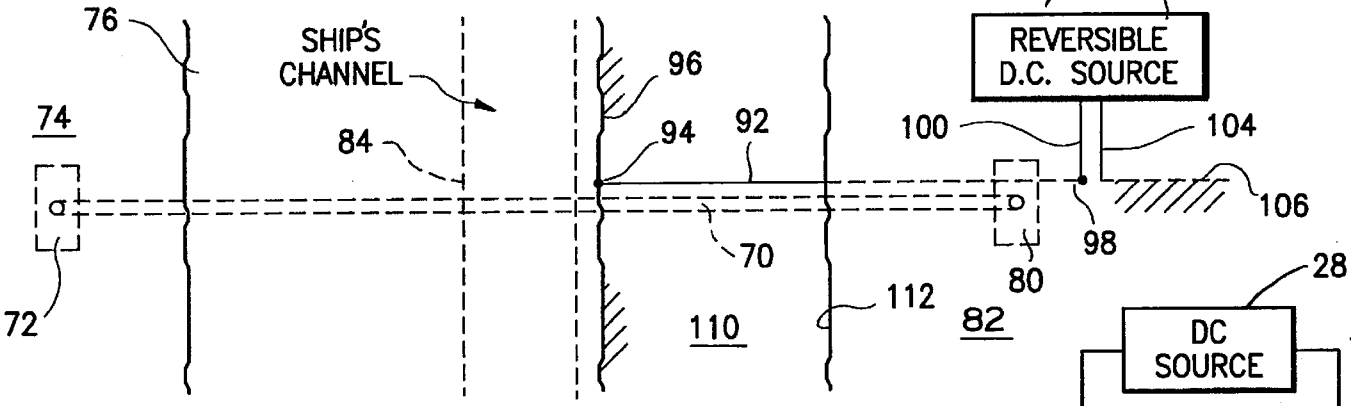
FIG. 4 is a top plan view of the system of FIG. 3.
Figure 5:
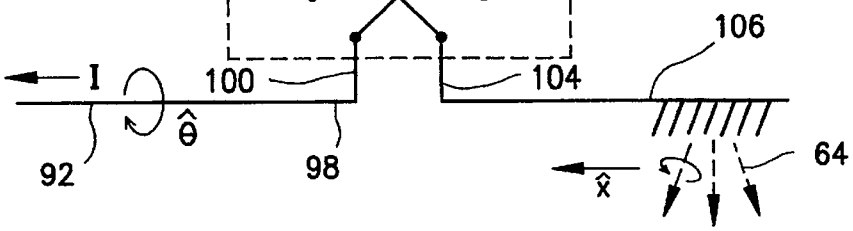
FIG. 5 is a diagrammatic illustration of the power supply and resulting current flow in the system of FIG. 3.

Another embodiment of the invention is illustrated in FIGS. 3–5, wherein the grounded guide cable of the invention is utilized to guide the drilling of a single borehole. In this case, a borehole 70 is to be drilled, as by a drilling tool 50 (FIG. 2) from an entrance location 72 on a near side 74 of an obstacle such as a river 76 to an exit location 80 on a far side 82 of the obstacle. The river is illustrated as including an inaccessible region, in this case a restricted ship's channel 84, which cannot be used for placement of a guide cable for guiding the drilling of borehole 70.

In the example of FIG. 3, the borehole 70 is started at the entrance 72 and, using known survey and logging techniques, is drilled to a point below about the far side 86 of the inaccessible region. In those cases where it is desirable, or even critical, to have the borehole 70 terminate at a specified location, such as the exit region 80, with an accuracy greater than that which can be provided by conventional survey techniques, guidance from the region 86 is provided by the grounded wire system 90 of the present invention. The system 90 is similar to that described above, in that it includes a electrically conductive guide cable 92 which is a 5/16" diameter electrically insulated and armored monocable. However, in this case the cable does not extend the full length of the borehole being drilled but instead is a surface cable which starts at the intermediate region 86. One end 94 of cable 92 is mechanically and electrically connected in region 86 to a grounding wire 96, which preferably is a bare (uninsulated) wire which is placed on the surface of the ground perpendicular to guide cable 92.

The cable 92 extends along the surface of the ground to the exit region 80 and is electrically connected at a second end 98 to one terminal 100 of a reversible DC source 102. The other terminal 104 of source 102 is electrically connected to a second grounding wire 106, which is a bare (uninsulated) wire which may be perpendicular to guidewire 92, but is preferably collinear therewith.

In the example of FIG. 3, the guide cable 92 is placed on the bed 110 of river 76 above the path which is to be followed by the borehole 70 as it is being drilled. Thus, as illustrated, guide cable 92 leads from the region 86 in the river above the location of the drilling tool, past the far side riverbank 112 and to the exit location 80 on the far side 82 of the river. The guide cable may be placed in the river at any time, but in one embodiment may be placed directly above the drilling tool when the borehole 70 has reached the far side of the ships channel 84. The guide wire then is laid along the desired path of the borehole to the exact exit point to provide precise guidance.

The grounding wire 96 is also laid on the river bed, and preferable extends upstream and downstream from the cable 92. The bare grounding wire provides an electrical ground connection with the river bed along the entire length of the bare wire to distribute the ground currents and to carry them as far away from the drilling tool as is possible.

The cable 92 may be buried on the far side 82 of the river, if desired, to its connection with the DC source 102. The ground wire 106 is also buried to provide a good electrical contact with the Earth. This ground wire extends away from cable 92 and from borehole 70, again to distribute ground currents and to reduce their effect on the sensor carried by the drilling tool.

The reversible DC source 102 is illustrated in FIG. 5 as including a source 28 and a reversing switch 30 as described with respect to FIG. 2. As illustrated, the magnetic field vector $\hat{\theta}$ a represents the direction of the field H produced by the current I flowing in the guidewire 92, while the field vector $\hat{X}$ represents the field direction produced by the ground current 64, described with respect to FIG. 2.

While the foregoing discussion has been directed primarily to a direct current system producing static magnetic fields to enable the use of conventional static field magnetometers, it is also possible to use a low frequency alternating current source. Such a source may have a frequency of from a fraction of one Hz up to about 1 KHz, depending upon the conductivity of the Earth or of water in the region of the borehole being drilled. However, use of an AC source would require provision of AC magnetic field sensors in addition to the static magnetic field sensors described above.

Although the present invention has been described in terms of preferred embodiments, it will be understood that numerous modifications and variations may be made without departing from the true spirit and scope thereof, as set forth in the accompanying claims.

What is claimed is:

1. A method for guiding the drilling of a borehole along a subsurface path, comprising:

positioning an elongated electrically conductive and insulated subsurface guide cable adjacent a desired path to be followed by a subsurface borehole to be drilled, the desired path extending through a resultant magnetic field including at least the Earth's apparent magnetic field;

connecting a first terminal of a current source to a first end of said guide cable;

connecting a second end of said guide cable to electrical ground;

connecting a second terminal of said current source to electrical ground to provide a return ground path for current flowing in the guide cable;

supplying from said source a current of known amplitude in a first direction to said first end of said guide cable to cause said current to flow to said electrical ground at said second end of said guide cable and to return to said second terminal of said source for a first period of time to produce changes in said resultant magnetic field in the region of said desired path;

measuring, at a subsurface borehole being drilled through the Earth along said path, vector components of said resultant magnetic field and;

determining, from changes in said vector components of said resultant magnetic field the distance and direction from said borehole being drilled to said guide cable.

2. The method of claim 1, further including supplying, for a second period of time, said current of known amplitude in a second direction to produce further changes in said vector components of said resultant magnetic field.

3. The method of claim 1, further including connecting a ground return wire between said second end of said guide cable and said second terminal of said current source to provide said ground return path.

4. The method of claim 1, wherein positioning said guide cable includes locating the guide cable in a subsurface borehole substantially parallel to said desired path.

5. The method of claim 1, wherein positioning said guide cable includes locating the guide cable on the Earth's surface in a location substantially parallel to said desired path.

6. A guidance system for a subsurface borehole comprising:

an entry location for a borehole to be drilled along a desired path past an inaccessible region, said entry location being at a near side of said region;

an exit location for said borehole said exit location being at a far end of said desired path and at a far side of said inaccessible region;

a reversible electric current source having first and second terminals and located near said exit location;

an electrically insulated guide cable having first and second ends and connected at said first end to said first terminal and located along a path extending from said exit location toward said entry location;

an uninsulated ground wire connected to said second end of said guide cable, said ground wire extending generally perpendicular to said guide cable;

a second ground wire connected to said second terminal, said current source supplying a current of known amplitude for a first period of time in a first direction to said first end of said guide cable to cause current to flow to said ground wire at said second end of said guide cable and to return to said second terminal of said source to produce a first resultant magnetic field in the region of said desired path, and thereafter supplying said current of known amplitude for a second period of time in a second direction to produce a second resultant magnetic field in the region of said desired path; and magnetic field sensor means located on a drill for drilling said borehole, said sensor means measuring vector components of said resultant magnetic fields.

7. The system of claim 6, wherein said guide cable and said uninsulated ground wire are located on the Earth's surface.

8. The system of claim 7, wherein said guide cable extends from said inaccessible region to said exit location.

9. The system of claim 8, wherein said second guide wire is generally collinear with said desired paths.

* * * * *